US008739745B2

(12) United States Patent
Quix et al.

(10) Patent No.: US 8,739,745 B2
(45) Date of Patent: Jun. 3, 2014

(54) COOLING SYSTEM AND METHOD

(75) Inventors: Hans Guenter Quix, Herzogenrath (DE); Jan Mehring, Cologne (DE); Bernd Brinkmann, Dormagen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/591,076

(22) Filed: Aug. 21, 2012

(65) Prior Publication Data

US 2013/0047940 A1 Feb. 28, 2013

(30) Foreign Application Priority Data

Aug. 23, 2011 (EP) ..... 11178430
Aug. 23, 2011 (EP) ..... 11178432

(51) Int. Cl.
*F01P 7/14* (2006.01)

(52) U.S. Cl.
USPC ..... 123/41.08; 123/41.02; 123/41.82 R

(58) Field of Classification Search
CPC ..... F01P 3/02; F01P 2003/027; F01P 7/165; F01P 7/16; F01P 2003/024; F01P 2003/028; F01P 2025/31; F01P 2025/08; F01P 1/40
USPC ..... 123/41.08, 41.09, 41.1, 41.05, 41.17, 123/41.01, 41.02, 41.82
See application file for complete search history.

(56) References Cited

U.S. PATENT DOCUMENTS

| | | | | |
|---|---|---|---|---|
| 4,539,942 | A | 9/1985 | Kobayashi et al. | |
| 5,385,123 | A | 1/1995 | Evans | |
| 6,698,388 | B2 * | 3/2004 | Brace et al. | 123/41.28 |
| 6,810,838 | B1 * | 11/2004 | Hellman | 123/41.28 |
| 7,207,298 | B2 * | 4/2007 | Lee | 123/41.29 |
| 2003/0000487 | A1 * | 1/2003 | Schmitt | 123/41.72 |
| 2008/0060592 | A1 * | 3/2008 | Mehring et al. | 123/41.72 |
| 2010/0186684 | A1 * | 7/2010 | Utsuno | 123/41.1 |
| 2011/0023797 | A1 * | 2/2011 | Lenz et al. | 123/41.29 |
| 2011/0197832 | A1 * | 8/2011 | Berkemeier et al. | 123/41.44 |
| 2011/0296834 | A1 * | 12/2011 | Kuhlbach et al. | 60/605.3 |

FOREIGN PATENT DOCUMENTS

| | | | |
|---|---|---|---|
| DE | 19524424 | A1 | 1/1996 |
| DE | 19628542 | A1 | 1/1998 |
| DE | 10127219 | A1 | 11/2002 |
| DE | 10219481 | A1 | 11/2003 |
| DE | 10261070 | A1 | 5/2004 |
| DE | 10342935 | A1 | 4/2005 |
| EP | 0816651 | B1 | 11/2001 |
| EP | 1239129 | A2 | 9/2002 |
| EP | 1405991 | A1 | 10/2003 |
| EP | 1900919 | B1 | 3/2011 |
| FR | 2594484 | A1 | 8/1987 |
| FR | 2860833 | A1 | 4/2005 |
| JP | 57176317 | A | 10/1982 |
| KR | 20040033579 | A | 4/2004 |

* cited by examiner

*Primary Examiner* — Noah Kamen
*Assistant Examiner* — Long T Tran
(74) *Attorney, Agent, or Firm* — Julia Voutyras; Alleman Hall McCoy Russell & Tuttle LLP

(57) ABSTRACT

A cooling system for an engine. The cooling system includes a flow control element including an inlet in fluidic communication with an outlet of a cylinder head water jacket, a first outlet port in fluidic communication with a heat exchanger, and a second outlet port in fluidic communication with an inlet of an engine block water jacket.

16 Claims, 3 Drawing Sheets

COOLING SYSTEM AND METHOD

CROSS-REFERENCE TO RELATED APPLICATIONS

This application claims priority to European Patent Application Number 11178432.8 filed on Aug. 23, 2011 and European Patent Application Number 11178430.2 filed on Aug. 23, 2011, the entire contents of each of which are hereby incorporated herein by reference for all purposes.

BACKGROUND/SUMMARY

Internal combustion engines may include engine blocks and cylinders heads. Each of the engine block and the cylinder head may be traversed by separate coolant circuits or at least predominantly separated cooling circuits. This engine cooling arrangement may be referred to as a split cooling system. In this way, the cylinder head, which may be thermally coupled to the combustion chamber wall, the intake manifold, and the engine block, which is thermally coupled to the friction points, can be cooled differently, if desired. The split cooling system (e.g., split coolant circuit) may attempt to cool the cylinder head during a warm-up period while reducing or in some cases inhibiting cooling of the engine block so that the engine block may achieve a desired operating temperature more quickly. In other words, the split coolant circuit may be thought of as a single cooling circuit for an engine in which the water jacket in the cylinder head is separated from the water jacket in the engine block via suitable mechanisms. In some embodiments, however, there may be low levels of leakage from the cylinder head water jacket to the engine block water jacket, wherein the leakage quantities are so small that one can nevertheless refer to this as a split coolant circuit.

FR 2 860 833 A1 discloses a cooling circuit of an internal combustion engine having at least one cylinder head and a cylinder housing, said cooling circuit being composed of at least three cooling passages. The circuit has a heat exchanger, a driver for a heat exchange medium, and at least one controller for controlling the flow of heat exchange medium through the cylinder head, the cylinder housing or the heat exchanger. The cooling circuit has at least three independent passages for engine cooling, wherein the first and second passages are arranged in the cylinder head and the third passage is arranged in the cylinder housing, and wherein the passages are independent of one another and comprise at least one inlet and one outlet, such that they permit an independent flow of the heat exchange medium through each of the passages of the cylinder head and of the cylinder housing. FR 2 860 833 A1 discloses that three controllers (e.g., valves) are provided in order to be able to regulate different circulations of the heat exchange medium. One controller is arranged at the inlet side and one controller is arranged at the outlet side. The third controller is connected to the other two controllers.

U.S. Pat. No. 5,385,123 discloses a split coolant circuit having a single thermostat which, in one embodiment, is arranged in an outlet line of the outlet side of a cylinder head to a pump, the line of which opens out at the inlet side in the cylinder head. A bypass and a block line branch off from the outlet line and extend into the engine block. The bypass leads to the pump. In the aforementioned embodiment, the thermostat is arranged in the branch of the three lines. During the warm-up phase, the thermostat closes the block line, wherein the bypass is fully open. When the thermostat is closed, the coolant flows through the bypass to the pump, and from there into the cylinder head. As the coolant temperature rises, the thermostat successively closes the bypass, such that the direct flow in the direction of the pump is continuously reduced, and is completely shut off when the bypass is completely closed. The coolant then flows out of the cylinder head through the outlet line and the block line into the engine block, which is connected to a cooler, and from there to the pump.

The Inventors have recognized several disadvantages with the split cooling design in U.S. Pat. No. 5,385,123 and the cooling system disclosed in FR 2 860 833. Firstly, the cooling systems disclosed in U.S. Pat. No. 5,385,123 and FR 2 860 833 may be bulky, thereby reducing the engine's compactness and increasing the size and cost of the engine. As a result, the cost of the engine may be increased. Moreover, the control system for controlling the 3 independent engine cooling passages in FR 2 860 833 may be complex and costly.

To solve at least some of the aforementioned problems a cooling system for an engine is provided. The cooling system includes a flow control element having an inlet in fluidic communication with an outlet of a cylinder head water jacket, a first outlet port in fluidic communication with a heat exchanger, and a second outlet port in fluidic communication with an inlet of an engine block water jacket.

In this way, the coolant may be flowed from the outlet of the cylinder head water jacket to the inlet of the engine block water jacket during some operating conditions and/or from the outlet of the cylinder head water jacket to a heat exchanger during other operating conditions. As a result, coolant may be flowed in series through the cylinder head and the engine block bypassing the heat exchanger, enabling a heater bypass line to be omitted from the cooling system, if desired. Moreover, the flow control element may be used to separately adjust the coolant flow through both the cylinder head water jacket and the cylinder block water jacket based on the engine's operating conditions.

The above advantages and other advantages, and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

Figure 1:
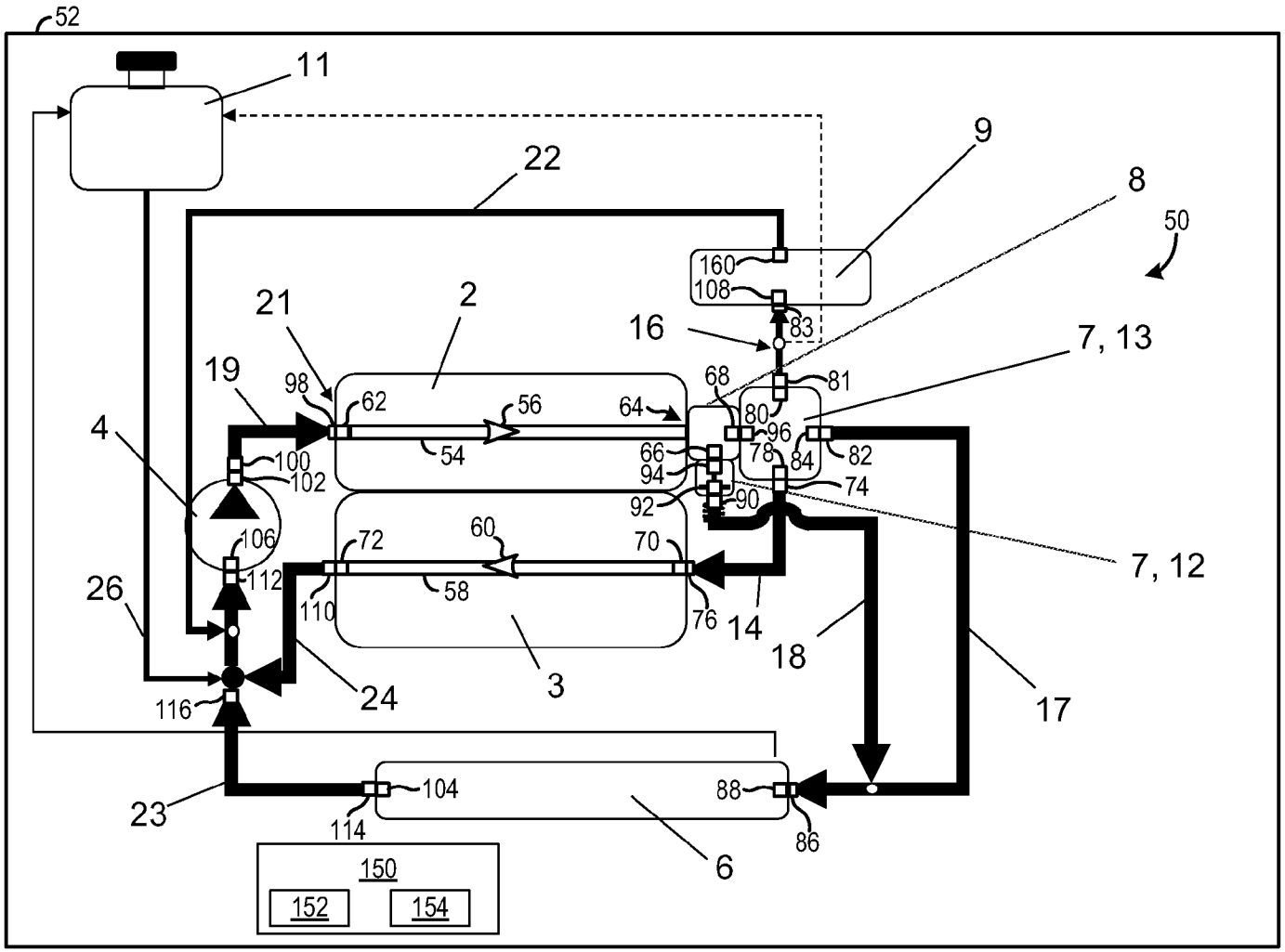
FIG. 1 shows a diagrammatic illustration of a split coolant circuit.

The figures are described in greater detail below.

DETAILED DESCRIPTION

A split coolant circuit is described herein. The split coolant circuit includes a flow control element arranged on an outlet housing of a cylinder head water jacket. The flow control element may include a thermostat and a proportional valve which is separate from said thermostat. Furthermore, the thermostat may be connected in a parallel flow configuration with the proportional valve. Additionally, the proportional valve may have an engine block connecting coolant line coupled thereto leading to the engine block water jacket, a heater connecting coolant line coupled thereto leading to a heater, and a cooler connecting line coupled thereto leading to a cooler. Additionally, the thermostat may also have a connecting coolant line coupled thereto and leading to the cooler. However, other coolant circuit configurations have been contemplated.

In some examples, coolant from the cylinder head water jacket may be flowed directly into the block water jacket. Such an arrangement enables a bypass line positioned upstream and downstream of the cooler (e.g., from the thermostat to the block entrance, bypassing the radiator) to be omitted, if desired. As a result, the cost of the split coolant circuit may be decreased. In such an example, the engine block water jacket may perform the function of the aforementioned bypass line, if desired, specifically that of bypassing the cooler, such that the coolant is not cooled unnecessarily, for example in the warm-up phase of the internal combustion engine. This may lead to higher material and also oil temperatures, as a result of which friction and thermal losses are reduced. In this way, the engine may be brought up to a desired temperature more quickly and after the desired operating temperature achieved adjustable amounts of cooling may be provided to both the cylinder head and the engine block. As a result, engine fuel consumption and engine emissions may be reduced, thereby increasing the longevity of the internal combustion engine.

Furthermore, an oppositely-directed coolant flow pattern in the two separate cooling regions (e.g., the cylinder head water jacket and the engine block water jacket) may also be used in some examples. In the cylinder head water jacket, the coolant flows from the inlet side to the outlet side. In contrast, the coolant is supplied to the block water jacket at that side which corresponds to the outlet side of the cylinder head water jacket. In the engine block water jacket, therefore, the coolant flows, as it were, in the reverse direction, from the outlet side to the inlet side, in relation to the flow direction in the cylinder head water jacket.

It will be appreciated that the cylinder head water jacket and the engine block water jacket may not transfer coolant at points between the inlet and the outlet of each respective water jacket. Specifically, the cylinder head water jacket and the engine block water jacket may be coupled in a series flow configuration. Moreover, the flow through each water jacket may be substantially in opposite directions. That is to say, that the inlet of the engine block water jacket may be on the same side of the engine as the outlet of the cylinder head water jacket, in some examples. Likewise, the outlet of the engine block water jacket may be on the same side of the engine as the inlet of the cylinder head water jacket, in some examples.

A pump connecting coolant line may connect the pump to the inlet of the cylinder head water jacket. In this way, the coolant can pass out of the cylinder head water jacket into the outlet (e.g., outlet housing) of the cylinder head water jacket. Furthermore, a heater line may lead to the heater may branch off from the proportional valve. The heating return line opens out, upstream of the pump, in a cooler return line which is in fluidic communication with the pump.

The return coolant (e.g., water) line which leads out of the block water jacket likewise is in fluidic communication with cooler return line, likewise upstream of the pump. In contrast, the connecting coolant line which leads out of the thermostat advantageously issues into the cylinder head coolant (e.g., water) line upstream of the cooler. Further components of the coolant circuit may be provided. For example, a ventilation device may be provided which is connected to the heater line and to the cooler, and the return line of which likewise flows into the cooler return line upstream of the pump.

In some examples the thermostat, which functions as a part-load thermostat, may be connected to the cooler via the connecting line, wherein the connecting line flows into the cooler line upstream of the cooler but downstream of the proportional valve, wherein the engine block water jacket bypasses the cooler and opens out directly in the cooler return line.

Further in some examples, a flow control element (e.g., the proportional valve and the thermostat) may be switchable as a function of operating modes of the internal combustion engine. One operating mode of the engine may be a warm-up phase when the engine is below a predetermined threshold temperature. Another operating mode may be a "warm" phase when the engine has reached or surpassed the predetermined threshold temperature. The flow control element may also be adjusted based on (e.g., as a function of) the load on the internal combustion engine and/or the power output of the internal combustion engine. There may be a partial-load mode of operation as well as a high load mode of operation.

In a warm-up mode of the internal combustion engine when the engine is operated with a partial load, all the paths of the proportional valve, that is to say the path to the engine block coolant line, the path to the heater line and the path to the cooler line of the proportional valve and also the thermostat to the connecting line, are closed. In said state, the split coolant circuit has, as it were, a flow with a magnitude of zero both in the block water jacket and also in the head water jacket. The coolant temperature may be less than 60° C. Thus, the threshold operating temperature for the warm-up mode may be 60° C.

In some examples, when the coolant temperature has a magnitude of greater than 60° C. and less than 75° C., the path of the proportional valve to the heater line opens in a continuous fashion until it is completely open. The no-flow strategy of the cylinder head water jacket is ended, and a partial flow of the coolant flows out of the outlet housing via the proportional valve into the heater line, in this example. The path to the block water line remains closed, such that the coolant flow in the block water jacket has a magnitude of zero, in this example. The flow through the cylinder head water jacket may be of a magnitude which can also flow through the heater line, in this example. In this respect, the coolant flow in the cylinder head water jacket is relatively small, which promotes improved warm-up behavior. The heater can nevertheless provide desired heating to the vehicle cabin.

In some examples, when the coolant temperature has a magnitude of greater than 75° C. and less than 85° C., the path to the heater line is completely open, wherein the path to the block water line opens in a continuous fashion. With the end of the no-flow strategy, a small coolant flow may be permitted in the block water jacket, in this example. The path to the cooler line remains closed, in this example.

Further in some examples, when the coolant temperature has a magnitude of greater than 85° C. and less than 100° C., the path to the heater line is fully open as before. In contrast, the path to the block water line may controlled by the proportional valve such that the block temperature can be set to a high magnitude, for example to over 105° C., preferably to approximately 115° C., in this example. The thermostat may continue to close the path to the connecting line when the coolant temperature in the outlet housing or in the cylinder head water jacket lies below for example 100° C. or preferably below 105° C., in this example.

When the warm-up phase has come to an end, the control components may then be controlled as a function of the operating state "engine at operating temperature and partial load", in some examples. In said operating mode, that is to say in the case of an internal combustion engine which is above a threshold temperature (e.g., "warm") and being operated at partial load, the path to the heater line may be open, and the path to the block water line may be regulated such that the block water temperature can be set to a high magnitude of for example 115° C. If the coolant in the cylinder head water jacket or in the outlet housing has a magnitude of greater than 100° C., the thermostat to the connecting line may open. The coolant flow in the cylinder head water jacket is thus further increased, in this example. Since an additional part of the cylinder head coolant flow is thus conducted via the main cooler, the temperature in the cylinder head water jacket can be easily regulated, below the opening temperature, in some examples. The coolant flow may be controlled by the thermostat (e.g., opening temperature for example 100° C.) together with the proportional valve when the internal combustion engine is at its operating temperature and is being operated in part load, in some examples. Therefore, the thermostat may be designed as a part-load thermostat, and is configured to open in part-load operation when the temperature in the cylinder head water jacket or in the outlet housing has a magnitude greater than its opening temperature, in some examples. However, other thermostat operating schemas have been contemplated.

In part-load operation, the internal combustion engine may be operated with elevated temperature in both regions independently, in some examples. However, other control techniques have been contemplated.

The path of the proportional valve to the cooler line may be opened if needed when, for example, the internal combustion engine is operated at relatively high load. For this purpose, the proportional valve may open the line to the main cooler to regulate the temperature of the cylinder head water jacket to, for example, 85° C. The part-load thermostat may then be closed, because the opening temperature is not reached. The branch to the block water jacket is then fully open, in this example. The path may be regulated such that the coolant temperature in the block water jacket is below a predetermined threshold value, for example regulated to a magnitude of 90° C., because the engine block may have a greater cooling need at relatively high load of the internal combustion engine.

In the event of a malfunction of the proportional valve and therefore an inadequate coolant flow to the main cooler, the part-load thermostat also may have a protective function. In this case, in the event of an increase in the coolant temperature above the opening temperature, the part-load thermostat may open and conduct coolant to the main cooler. The part-load thermostat may also function as a safety thermostat because excessive overheating is prevented by opening in the direction of the cooler, in some examples.

A further operating state or operating mode may be the internal combustion engine is operated in the warm-up phase at high load. In said operating mode, the path to the heater line is completely open, wherein the path to the block water line may be regulated by the proportional valve. The path may be regulated such that the coolant temperature in the block water jacket is below a predetermined threshold value, for example regulated to a magnitude of 90° C., because the engine block may have high cooling demand at full load of the internal combustion engine. The coolant flow in the cylinder head water jacket may be regulated by the proportional valve, wherein a temperature of 85° C. can be set in the cylinder head water jacket.

A further operating mode may be the internal combustion engine is at its operating temperature and is being operated at high load or full load. In said operating mode, the path to the heater line may be closed. This may be implemented if, for example at high ambient temperatures, the maximum cooling power must be generated, in some examples. The path to the block water line can be regulated by the proportional valve. The path may be regulated such that the coolant temperature in the block water jacket is low, for example regulated to a magnitude of 90° C., because the engine block may have a high cooling demand at full load of the internal combustion engine. The coolant flow in the cylinder head water jacket may be regulated by the proportional valve, wherein a temperature of 85° C. can be set in the cylinder head water jacket, in some examples. The part-load thermostat accordingly may not open at all because the temperature lies below its opening temperature. If the temperature nevertheless rises above the opening temperature, the thermostat may open and perform its protective function by virtue of coolant additionally being conducted to the cooler, in some examples.

If the flow control element (e.g., the two components the proportional valve and the thermostat (e.g., part load thermostat)), is as a function of the operating mode a control unit may be used to implement the aforementioned control strategies. The control unit may include memory executable by a processor. The control strategies may be stored via code in the memory. The control unit may be included in the engine and/or vehicle.

In some examples, the internal combustion engine (e.g., the engine block water jacket and the cylinder head water jacket) may be operated with the "no-flow strategy" for a desired period of time. In other words, coolant flow may be substantially inhibited in the engine block and/or the cylinder head. During this mode, the cabin heater may be supplied by the corresponding path of the proportional valve being opened. When cabin heating is desired, the no-flow strategy may be discontinued in the cylinder head water jacket but may be maintained in the block water jacket.

In some examples, the coolant inlet temperature as it enters the engine block may be raised by approximately 3 to 5 K, because the in-feed takes place from the outlet of the cylinder head circuit. Furthermore, the engine block temperature, that is to say the material temperature itself, may be raised because the temperature may be controlled by the part-load thermostat, and a reduced coolant flow through the block water jacket may be generated in some examples. A variable operating temperature may be set in the cylinder head water jacket in accordance with the above-stated operating modes, in some examples. At part load, the temperature may even be raised up to 115° C., if said temperature is exceeded; the part-load thermostat may open and thus increases the magnitude of the coolant flow, and conducts a part of said coolant flow via the cooler, in some examples. The coolant flow through the heater may also be variable during the warm-up phase, in some examples. As previously discussed, the coolant flow in the block water jacket may be in the opposite direction to the coolant flow in the cylinder head water jacket. Also, the fact that the coolant which emerges from the cylinder head, and which, as it were, has been warmed up, is supplied to the block water jacket may enable the engine block to be thermally managed to reduce friction losses in some examples.

In some examples, the proportional valve may only flow a portion of the coolant travelling therethrough from the cylinder head water jacket to the engine block water jacket due to the desired cooling of the engine block may be less than (e.g., 30% to 50% of) the desired cooling power of the cylinder head. Thus, the engine block temperature may be adjusted via the adjustment in coolant flow, in some examples. When a portion coolant flow is conducted via the cooler the heater circuit may be closed, because the cooling power at the vehicle cooler may be provided at high ambient temperatures, in some examples. The cabin heater may be inactive, during such operation. This may lead to a change in the pressure conditions, and therefore to an increased flow through the main cooler, in some examples. As a result of the configuration in which the thermostat permits the coolant flow through the cooler when the internal combustion engine is at part load or for protection purposes, the thermostat may be designed, in some examples, as a single-acting thermostat which opens at relatively high temperatures, in order thereby to permit increased coolant temperatures in particular in the cylinder head water jacket, wherein in other operating modes which differ from this, the cylinder head coolant temperature can be reduced, that is to say is variable.

A cooling system 50 in an engine 52 is shown in FIG. 1. The cooling system 50 may include a split coolant circuit 1. The split coolant circuit 1 may include a cylinder head water jacket 2 and an engine block water jacket 3, a pump 4, a first heat exchanger 6 (e.g., a cooler, a radiator), a flow control element 7, an outlet housing 8 of the cylinder heat water jacket, and a second heat exchanger 9 (e.g., a heater, a cabin heater). Furthermore, the coolant circuit 1 may include a ventilation device 11. The second heat exchanger 9 includes an outlet 160 in fluidic communication with an inlet 106 of the pump 4.

The cylinder head water jacket 2 may be fluidly separated from the block water jacket 3. That is to say that coolant may not flow from the engine block water jacket to the cylinder head water jacket or vice-versa at points in between the inlets and outlets of the respective water jacket. The cylinder head water jacket 2 may include one or more coolant passages 54 through which coolant flows. Arrow 56 denotes the general direction of coolant flow through the cylinder head water jacket 2. Likewise, the engine block water jacket 3 may include one or more coolant passages 58 through which coolant flows. Arrow 60 denotes the general direction of coolant flow through the engine block water jacket 3. However, it will be appreciated that the cylinder head water jacket and/or the cylinder block water jacket may have other coolant flow characteristics. Generally, the flow direction in the split coolant circuit 1 is indicated via arrows. The cylinder head water jacket 2 includes at least one inlet 62 and at least one outlet 64. The outlet 64 may be referred to as a cylinder head outlet.

The outlet 64 may include a first outlet port 66 and a second outlet port 68. Likewise, the engine block water jacket 3 includes at least one inlet 70 and at least one outlet 72. The inlet 70 and the outlet 72 may be referred to as a block inlet and a block outlet, respectively. The flow control element 7 is in fluidic communication (e.g., direct fluidic communication) with the outlet 64 of the cylinder head water jacket 2. Specifically, in some examples, the flow control element 7 may be at least partially positioned in the outlet housing 8. The flow control element 7 may include a thermostat 12 and a valve 13 (e.g., proportional valve). In some examples, the thermostat 12 and the valve 13 may be separate. However, in other examples, the thermostat 12 and the valve 13 may be a single apparatus. The thermostat 12 may be arranged in a parallel flow configuration with the valve 13. That is to say that the inlets of the thermostat 12 and the valve 13 are in fluidic communication and the outlets of the thermostat and the valve are also in fluidic communication. However, other flow configurations have been contemplated.

A coolant (e.g., water) line 14 (e.g., block coolant line) is in fluidic communication with the valve 13 and the engine block water jacket. Coolant line 14 includes an inlet 74 and an outlet 76. The inlet 74 is in fluidic communication (e.g., direct fluidic communication) with an outlet port 78 of the flow control element 7. Specifically, the outlet port 78 is in the valve 13. However, other port positions have been contemplated.

The split coolant circuit 1 further includes a coolant line 16 (e.g., heater coolant line) in fluidic communication with the valve 13 and second heat exchanger 9. Thus, the coolant line 16 includes an inlet 81 in direct fluidic communication with an outlet port 80 of the flow control element 7. Specifically, the outlet port 80 is in the valve 13. However, other valve positions have been contemplated. The coolant line 16 also includes an outlet 83 in fluidic communication with an inlet 108 of the second heat exchanger 9.

The split coolant circuit 1 further includes a coolant line 17 (e.g., cooler coolant line) in fluidic communication with the valve 13 and the first heat exchanger 6 (e.g., cooler). Thus, the coolant line 17 includes an inlet 82 in fluidic communication (e.g., direct fluidic communication) with an outlet port 84 of the flow control element 7. Specifically, the outlet port 84 is in valve 13. The coolant line 17 further includes an outlet 86 in fluidic communication (e.g., direct fluidic communication) with an inlet 88 of the first heat exchanger 6.

The split coolant circuit 1 further includes connecting coolant line 18 in fluidic communication (e.g., direct fluidic communication) with the thermostat and the first heat exchanger 6. The coolant line 18 includes an inlet 90 in fluidic communication with an outlet port 92 of the flow control element 7. Specifically, the outlet port 92 is in the thermostat 12. Each of the outlet ports (78, 80, 84, and 92) may be referred to as a first, second, third, and/or fourth outlet port depending on the order in which they are introduced, in some examples. The coolant line 18 merges with or opens into coolant line 17.

The thermostat includes an inlet 94 in fluidic communication with the first outlet port 66 of the cylinder head water jacket 2. Likewise, the valve 13 includes an inlet 96 in fluidic communication with the second outlet port 68 of the cylinder head water jacket 2.

A coolant line 19 (e.g., pump coolant line) connects the pump 4 to the inlet side 21 of the cylinder head water jacket 2. Specifically, an outlet 98 of the coolant line 19 is in fluidic communication with the inlet 62 of the cylinder head water jacket 2. The coolant line 19 further includes an inlet 100 in fluidic communication with an outlet 102 of the pump 4. The outlet 102 may be the sole outlet of the pump 4, in some examples. However, other pump designs have been contemplated. Additionally, the outlet 102 may be referred to as a pump outlet.

The first heat exchanger 6 also includes an outlet 104 in fluidic communication with an inlet 106 of the pump 4. The inlet 106 may be referred to as a pump inlet. The split coolant circuit 1 further includes a return coolant line 23 (e.g., a cooler return line) in fluidic communication with the inlet 106 of the pump 4 and an outlet 104 of the first heat exchanger 6.

The split coolant circuit 1 further includes a return coolant line 22 in fluidic communication with an outlet 160 of the second heat exchanger 9 and the inlet 106 of the pump 4. In the depicted embodiment the return coolant line 22 merges with the return coolant line 23. Specifically, the return coolant line 22 opens into return coolant line 23. However, other arrangements have been contemplated.

The split coolant circuit 1 further includes a return coolant (e.g., water) line 24. The return coolant line 24 includes an inlet 110 and an outlet 112. The inlet 110 is in fluidic communication (e.g., direct fluidic communication) with the outlet 72 of the cylinder block water jacket 3 and the outlet 112 is in fluidic communication (e.g., direct fluidic communication) with the inlet 106 of the pump 4. The split coolant circuit 1 further includes a return line 23 (e.g., cooler return line). The return line 23 includes an inlet 114 in fluidic communication (e.g., direct fluidic communication) with the first heat exchanger 6 and an outlet 116 in fluidic communication with the return coolant line 24. Thus, the return line 23 and the return coolant line 24 merge at a location downstream of the heat exchanger. Moreover, the coolant line 24 extends from the outlet of the engine block water jacket and the inlet of the pump merge at a location downstream of the heat exchanger. It will be appreciated that, the return coolant line 24 may open into return line 23 or vice-versa in some examples. Furthermore, the connecting coolant line 18 which leads out of the thermostat 12 is in fluidic communication with the line 17 upstream of the first heat exchanger 6.

The ventilation device 11 is fluidly connected to the coolant line 16 and the first heat exchanger 6. Additionally, the return line 26 of said ventilation device is in fluidic communication with the return line 23, upstream of the pump 4.

It will be appreciated that a bypass line of the first heat exchanger 6 has been omitted from the depicted embodiment. As a result, the complexity and cost of the cooling system is reduced. It will be appreciated that the engine block water jacket 3 may function as a bypass line for the first heat exchanger 6 during some operating conditions. However, a bypass line may be included in other embodiments.

As previously discussed coolant flowing out of the cylinder head water jacket 2 may be flowed to the engine block water jacket based on the operating modes of the internal combustion engine. Additionally, the coolant flow in the block water jacket 3 flows in the opposite direction to the coolant flow in the cylinder head water jacket 2, in the depicted embodiment. However, other flow configurations have been contemplated.

The coolant is supplied to the block water jacket 3 at the outlet side in relation to the flow direction in the cylinder head water jacket 2. The coolant flows through the block water jacket 3 in the opposite direction to the flow direction in the cylinder head water jacket 2 and emerges at the inlet side in relation to the coolant flow in the cylinder head water jacket 2, and flows into the cooler return line 23.

The coolant temperature may be regulated or controlled by a proportional valve as a function of operating modes, in some examples. It will be appreciated that the coolant temperature may be correlated to engine temperature or vice-versa. In part-load operation of the internal combustion engine, the coolant temperature in the cylinder head water jacket 2 may be adjusted by the thermostat 12. The thermostat 12 may for example have an opening temperature of 100° C. or even of 115° C. or a value in between, such that the coolant temperature in the cylinder head water jacket can be set to said elevated value. When the internal combustion engine is at full load, the coolant temperature in the cylinder head water jacket may be set to approximately 85° C., and for a low temperature of approximately 90° C. to be set in the block water jacket. The thermostat may not open at all at said low temperatures, such that the coolant temperature is controlled solely by the proportional valve. The operating modes and the temperature control have already been described above. In some examples, the thermostat 12 adjusts the coolant flow through the thermostat when the coolant temperature exceeds a threshold value. In this way, the flow control element may be configured to increase coolant flow through the outlet port (84 and/or 92) and decreases coolant flow through the outlet port 78 in response to an increase in coolant temperature, in some examples. A controller 150 having memory 152 storing code executable by a processor 154 may be included in the cooling system 50. The operating modes described above may be stored in code.

Figure 2:
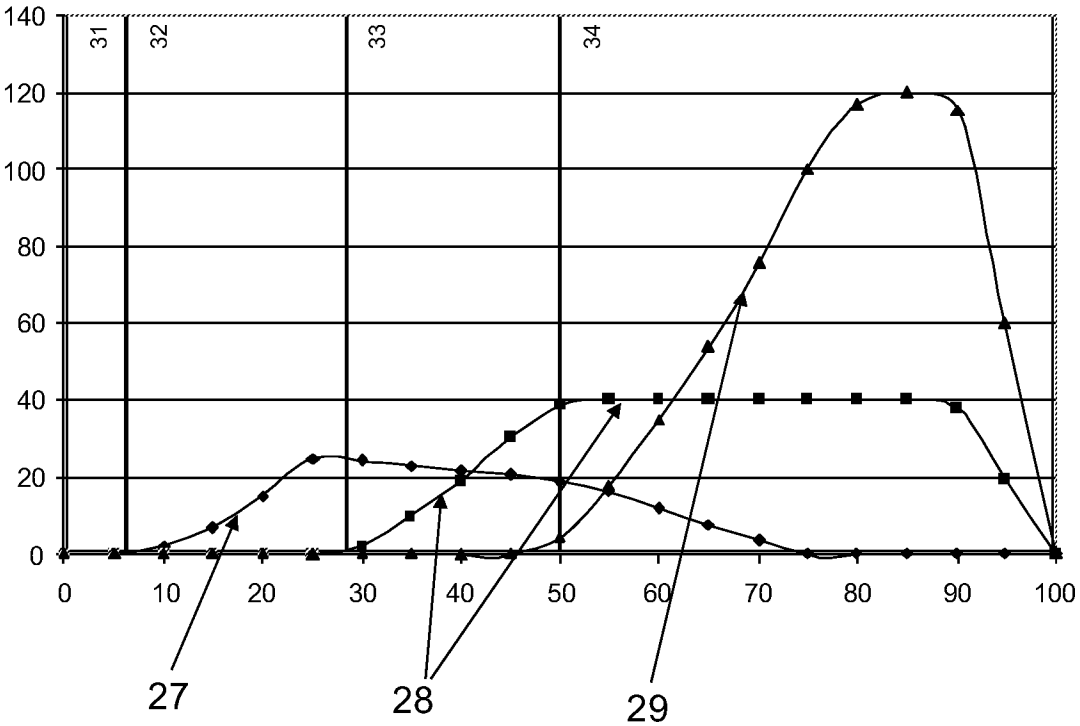
FIG. 2 shows a graph depicting an example of the control of the flow control element.

FIG. 2 shows a graph illustrating example coolant flows through the second heat exchanger (line 27), through the engine block water jacket (line 28) and through the first heat exchanger (line 29). The flow rate in liters/min is plotted on the vertical axis. The opening of the proportional valve 13 in % is plotted on the horizontal axis.

In a first phase 31, the flow rate in all of the lines and in the two water jackets 2 and 3 has a magnitude of zero (no-flow strategy).

In a second phase 32, an increasing amount of coolant flows to the second heat exchanger 9. The coolant flows in the engine block water jacket 3 and in the first heat exchanger 6 are zero (no-flow strategy in the block). There is a small coolant flow in the cylinder head water jacket. The proportional valve 13 opens the heater line in a continuously variable fashion until the path is completely open. This corresponds to an overall degree of opening of the proportional valve 13 of up to 30%.

In a third phase 33, the no-flow strategy in the block water jacket is also ended. The proportional valve may open said path in a continuous fashion. The path to the first heat exchanger 6 is, as before, closed. This is possible in part-load operation, such that the temperature control in the cylinder head water jacket may be achieved by the thermostat 12 (e.g., part-load).

As can be seen, the flow rate in the engine block water jacket 3 rises from 0 up to 40 liters/min, wherein in said phase, the flow through the heater decreases from 25 liters/min to approximately 20 liters/min. At the end of the third phase, the proportional valve is approximately 50% open, that is to say the path to the block water jacket and to the heater is open. In part-load operation, the temperature in the cylinder head water jacket may be regulated, and set to a high value, by the part-load thermostat. If said "threshold temperature" is reached, the part-load thermostat to the cooler opens.

If it is now detected that the internal combustion engine is being operated no longer at part load but rather at full load, the cylinder head coolant temperature may be regulated, in a fourth phase 34, to a value of approximately 85° C. The proportional valve 13 may open into the path to the cooler in a continuous fashion, such that a flow of up to 120 liters/min passes through said cooler. The path to the heater can be closed.

The stated values for the threshold temperatures and for the coolant flow rates of the proportional valve should self-evidently be understood to be merely exemplary, and serve merely as exemplary guideline values which are not in any way intended as being restrictive. In fact, said values should be determined, but not ultimately fixed, during the course of engine development.

Within the context of the invention, the expressions "substantially" or "approximately" or "circa" mean deviations from the exact value in each case by +/−10%, preferably by +/−5%, and/or deviations in the form of changes which have no significance in terms of function.

Figure 3:
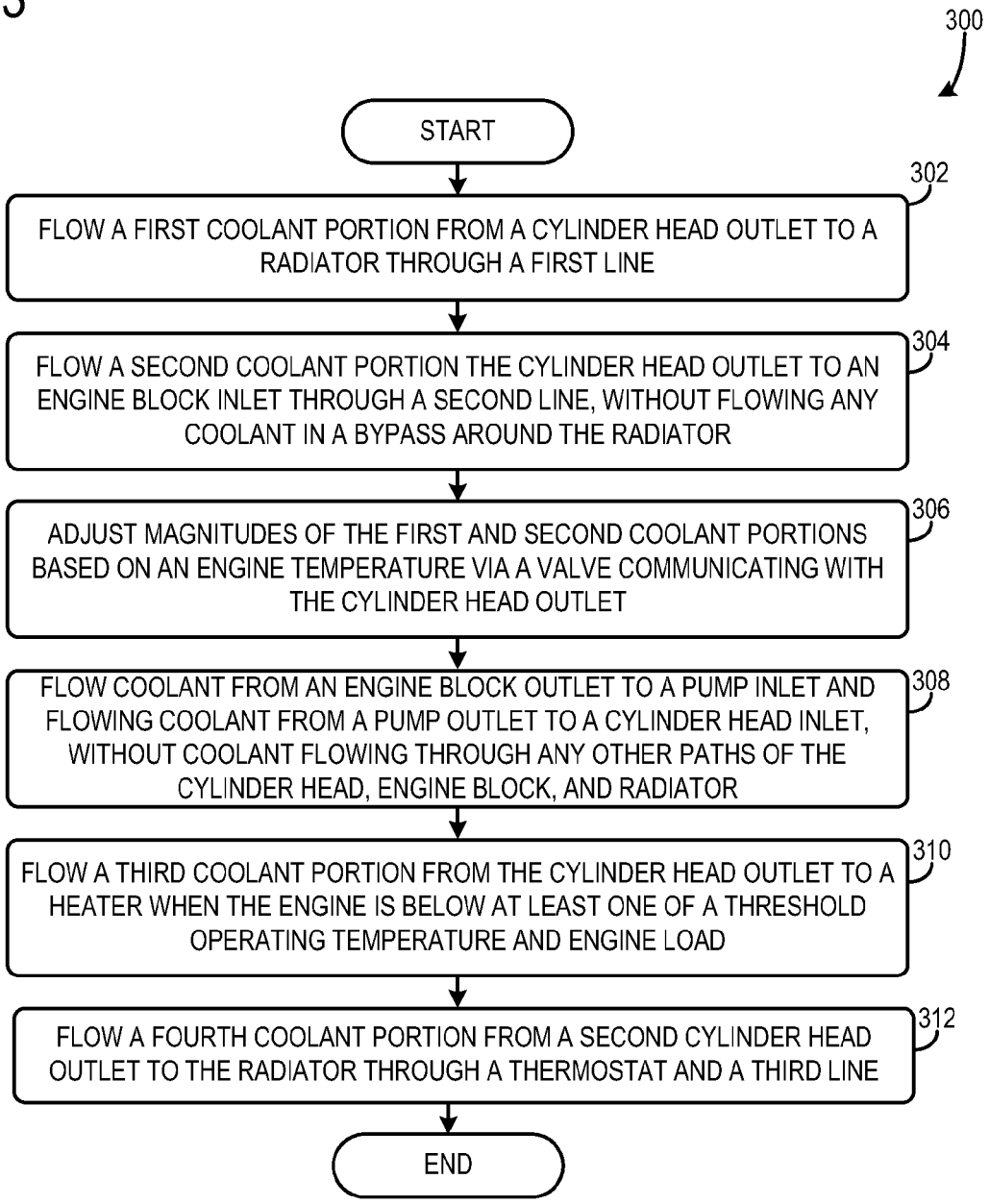
FIG. 3 shows a method for operation of a cooling system in an engine.

FIG. 3 shows a method 300 for operation of a cooling system in an engine. The method 300 may be implemented by the engine and cooling system described above with regard to FIG. 1 or may be implemented by other suitable engines and cooling systems.

At 302 the method includes flowing a first coolant portion from a cylinder head outlet to a radiator through a first line. It will be appreciated that in some embodiments the first portion of coolant flow may be substantially zero.

Next at 304 the method includes flowing a second coolant portion the cylinder head outlet to an engine block inlet through a second line, without flowing any coolant in a bypass around the radiator. It will be appreciated that in some embodiments the second portion of coolant flow may be substantially zero.

At 306 the method includes adjusting magnitudes of the first and second coolant portions based on an engine temperature via a valve communicating with the cylinder head outlet. In some examples adjusting the magnitudes of the first and second coolant portions includes, when coolant in the cylinder head water jacket is below a threshold temperature, inhibiting coolant flow to at least one of the engine block inlet and a radiator inlet from the cylinder head water jacket and when coolant in the cylinder head water jacket is above a threshold temperature, permitting coolant flow to at least one of the engine block inlet and the radiator inlet from the cylinder head water jacket. Further in some examples adjusting magnitudes of the first and second coolant portions is also based on engine load. Next at 308 the method includes flowing coolant from an engine block outlet to a pump inlet and flowing coolant from a pump outlet to a cylinder head inlet, without coolant flowing through any other paths of the cylinder head, engine block, and radiator.

At 310 the method may include flowing a third coolant portion from the cylinder head outlet to a heater when the engine is below at least one of a threshold operating temperature and engine load. Next at 312 the method may include flowing a fourth coolant portion from a second cylinder head outlet to the radiator through a thermostat and a third line.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to other types inline engines, opposed engines, V type engines, etc. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A split coolant circuit in an internal combustion engine comprising:

a pump;

a cylinder head water jacket including an inlet in fluidic communication with an outlet of the pump;

an engine block water jacket including an inlet in fluidic communication with an outlet of the cylinder head water jacket;

a first heat exchanger;

a second heat exchanger including an outlet in fluidic communication with an inlet of the pump and an inlet in fluidic communication with the outlet of the cylinder head water jacket; and a flow control element and thermostat coupled to the outlet of the cylinder head water jacket, the flow control element including a first outlet port in fluidic communication with an inlet of the engine block water jacket, a second outlet port in fluidic communication an inlet of the first heat exchanger, a third outlet port in fluidic communication with an inlet of the second heat exchanger, and a fourth outlet port from the thermostat in fluidic communication with the first heat exchanger.

2. The split coolant circuit of claim 1, where the engine block water jacket flows coolant in an opposite direction as coolant flow in the engine block water jacket.

3. The split coolant circuit of claim 1, further comprising a connecting coolant line in fluidic communication with an outlet of the engine block water jacket and an inlet of the pump, the connecting coolant line opening into a line downstream of the first heat exchanger.

4. The split coolant circuit of claim 1, where the flow control element includes a proportional valve in parallel fluidic communication with the outlet of the cylinder head water jacket, the proportional valve including the first outlet port, the second outlet port, and the third outlet port.

5. The split coolant circuit of claim 4, where connecting coolant lines from the second outlet port and the fourth outlet port fluidly merge upstream of the first heat exchanger.

6. The split coolant circuit of claim 4, where the thermostat and the proportional valve are independently adjustable.

7. The split coolant circuit of claim 4, where the thermostat adjusts coolant flow through the thermostat when coolant temperature exceeds a threshold value.

8. The split coolant circuit of claim 1, where the second heat exchanger is a cabin heater and the first heat exchanger is a radiator.

9. A cooling system in an engine comprising:

a combined flow control element and thermostat including an inlet in fluidic communication with an outlet of a cylinder head water jacket, a first outlet port in fluidic communication with a first heat exchanger, a second outlet port in fluidic communication with an inlet of an engine block water jacket, a third outlet port in fluidic communication with a second heat exchanger, and a fourth outlet port from the thermostat in fluidic communication with the first heat exchanger.

10. The cooling system of claim 9, where the flow control element adjusts coolant flow through the first and second outlet ports based on coolant temperature, the cooling system without a bypass around the heat exchanger from the outlet of the cylinder head water jacket to the inlet of the engine block water jacket.

11. The cooling system of claim 9, where the flow control element increases coolant flow through the first outlet port and decreases coolant flow through the second outlet port in response to an increase in coolant temperature.

12. The cooling system of claim 9, where the flow control element is controlled by a controller.

13. The cooling system of claim 9, where the flow control element comprises a valve, the valve adjusting coolant flow to at least one of the inlet of the engine block water jacket and an inlet of the first heat exchanger and the thermostat adjusting coolant flow to the inlet of the first heat exchanger.

14. The cooling system of claim 13, wherein the valve adjusts coolant flow to the inlet of the engine block water jacket and the inlet of the first heat exchanger.

15. The cooling system of claim 9, where coolant lines leading from an outlet of the engine block water jacket and an outlet of the heat exchanger fluidly merge and lead to an inlet of a pump.

16. The cooling system of claim 15, where the pump includes a sole outlet port in fluidic communication with an inlet of the cylinder head water jacket.

* * * * *